United States Patent [19]

Barna

[11] 4,261,320

[45] Apr. 14, 1981

[54] COMPOUND BOW

[76] Inventor: Alex J. Barna, 1216 Crawford St., Duquesne, Pa. 15110

[21] Appl. No.: 927,547

[22] Filed: Jul. 24, 1978

[51] Int. Cl.[3] ..... F41B 5/00

[52] U.S. Cl. ..... 124/24 R; 124/80; 124/88

[58] Field of Search ..... 124/23 R, 24 R, 90, 124/86, 80, 88

[56] References Cited

U.S. PATENT DOCUMENTS

| | | | |
|---|---|---|---|
| 3,486,495 | 12/1969 | Allen | 124/24 R |
| 3,958,551 | 5/1976 | Ketchum | 124/24 R |
| 3,986,026 | 11/1976 | Nishioka | 124/86 X |
| 4,054,118 | 10/1977 | McKee et al. | 124/23 R |
| 4,061,124 | 12/1977 | Groner | 124/23 R |
| 4,064,862 | 12/1977 | Groner | 124/23 R |
| 4,077,385 | 3/1978 | Fredrickson | 124/24 R |
| 4,078,537 | 3/1978 | Carella | 124/24 R |
| 4,078,538 | 3/1978 | Shepley | 124/24 R |

*Primary Examiner*—William R. Browne

*Attorney, Agent, or Firm*—Stanley J. Price, Jr.; John M. Adams

[57] ABSTRACT

A pair of limbs extend from opposite end portions of a handle member. Each limb has a free end portion upon which is rotatably and eccentrically mounted a pulley. A continuous cable is reeved about the pulleys and includes an arrow string portion extending between the limbs. The cable portions extend from the pulleys and through a cavity in the handle member where they are supported by idler pulleys. The pulleys are eccentrically mounted by devices that permit adjustments in the eccentric axis of rotation of each pulley relative to a limb to effect a change in the draw weight and draw length of the bow. Each pulley includes a pair of annular grooves positioned in spaced relation around the periphery of the pulley. A first and second set of slots extend radially through the rim portion of each pulley and into the first and second annular grooves respectively. The sets of slots are diametrically opposed on the rim. The cable is reeved about each pulley and positioned in a selected pair of slots so that a preselected amount of cable is positioned on the pulleys corresponding to a preselected draw length and/or draw weight of the bow.

16 Claims, 27 Drawing Figures

FIG. 22
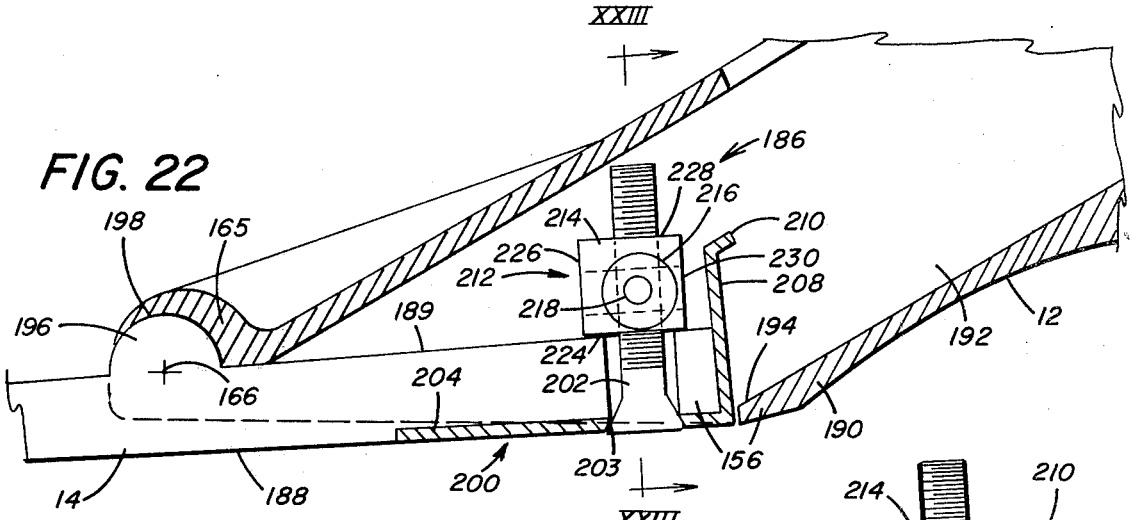
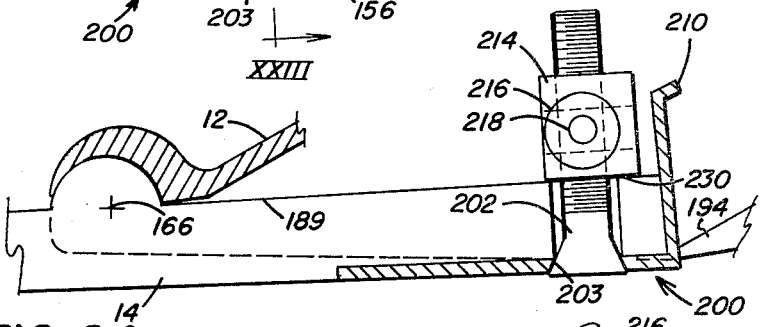
FIG. 24
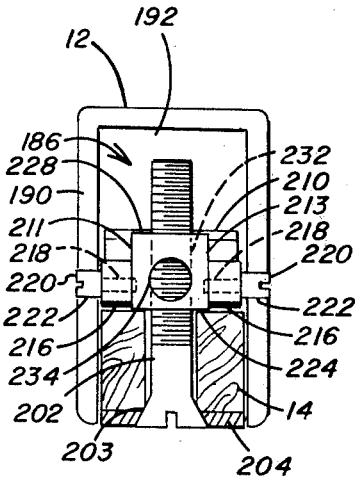
FIG. 23
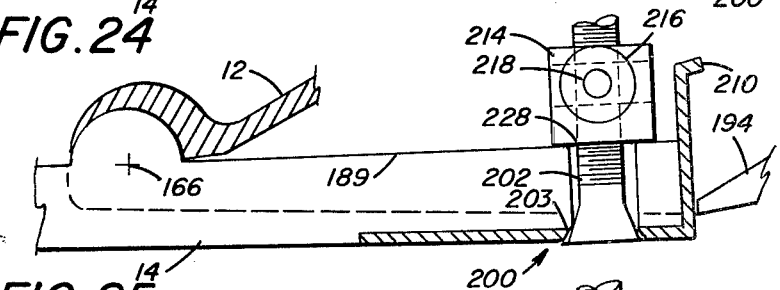
FIG. 25
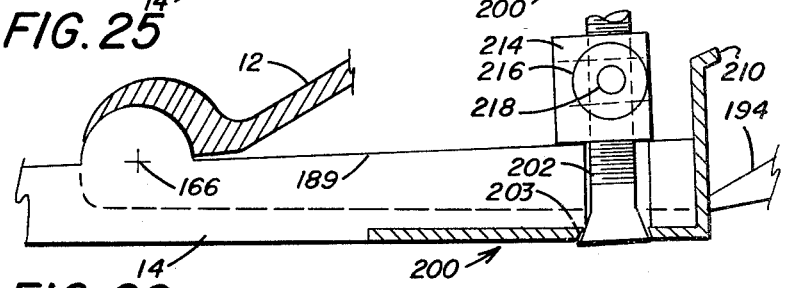
FIG. 26
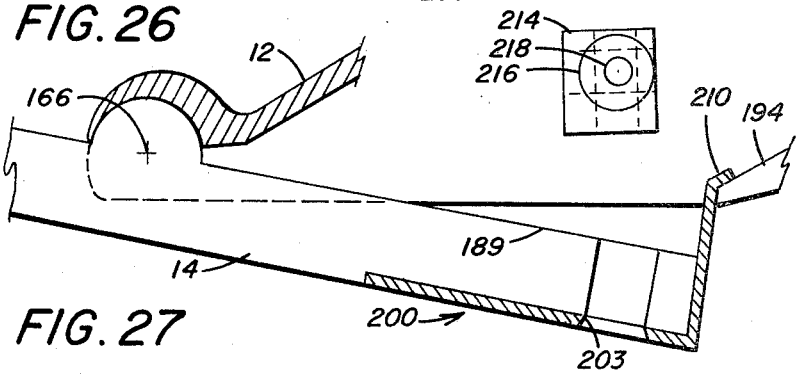
FIG. 27

COMPOUND BOW

BACKGROUND OF THE INVENTION

1. Field of the Invention

This invention relates to a compound bow, and more particularly to a compound bow that is operable to provide a plurality of adjustments in the draw length and/or a draw weight for eccentric pulleys of a given size on the limbs of the bow.

2. Description of the Prior Art

Compound bows, as well known in the art, utilize eccentrically positioned arrow string or cable mounting devices secured to the free ends of the bow limbs. The arrow string portion of the cable is reeved around the eccentric devices which includes wheels, pulleys and the like and are operable to provide a mechanical advantage to increase the amount of potential energy stored in the limbs as the arrow string is drawn. With this arrangement, when the arrow string is in the full draw position maximum potential energy is stored in the bow where the force required to maintain the arrow in the full draw position is less than the maximum draw weight of the bow. As the arrow string portion is being drawn, the draw weight or force applied to the bow increases to a maximum draw weight and lets off to a lower draw weight at the full draw position. Maximum energy is stored in the limbs without requiring maximum force to be applied to the arrow string to hold the arrow string at the full draw position. This substantially improves the performance of the bow and the ease of operation thereof. Samples of compound bows utilizing eccentric pulleys are disclosed in the following U.S. Pat. Nos.: 3,486,495; 3,948,551; 4,054,118; 4,061,124; 4,064,862 and 4,078,538.

The draw length or the length at which the arrow string is pulled to impart potential energy in the limbs of the bow is one of the principal variables of the compound bow and is determined by the physical requirements of the archer. Specifically, an archer of shorter height might prefer a draw length of 26 inches as compared to a taller archer who would prefer a draw length of 30 inches. However, in both cases each archer would desire the same percentage drop-off from the maximum draw weight exerted on the bow during the draw cycle to the weight exerted on the bow in the full draw position. Therefore, in order to effect a change in the draw length but maintain the same percentage drop-off it has been required in the past to utilize pulleys having different diameters so as to provide a change in the length of cable reeved about the pulley. By controlling the diameter size of the pulleys it has been possible to provide variations in the draw weight and draw length of the bow. Thus it has been the practice with conventional compound bows to change pulleys on the limbs to provide a preselected pulley diameter for a preselected draw length, requiring that a number of sets of pulleys of different diameters be made available for each bow. This practice substantially reduces the flexibility of a compound bow to be used for both hunting and competitive purposes and by more than one archer of varying physical characteristics.

The above mentioned U.S. Pat. No. 4,061,124 provides limited adjustment in the draw length of the arrow string for a pulley of a given diameter by increasing or decreasing the length of cable reeved about the pulley. This is accomplished by kinking portions of the cable to thereby limit the amount of cable that can be unwound from the pulley when the arrow string is drawn.

While it has been suggested by the prior art devices to effect a change in the draw length and accordingly the draw weight of the bow, the adjustments available are limited and necessitate substantial disassembly and assembly of components of the bow, particularly the pulley and the portion of the cable reeved around the pulley for eccentric pulley settings. Therefore, there is need to provide in a compound bow apparatus for effecting a plurality of adjustments in the draw length and draw weight of a bow without necessitating substantial disassembly and assembly of the bow so that a compound bow may be more efficiently used for both hunting and competitive purposes.

SUMMARY OF THE INVENTION

In accordance with the present invention there is provided a compound bow for propelling an arrow that includes a handle member for gripping the bow. A pair of limbs extend outwardly from opposite ends of the handle member for storing energy to propel the arrow. The limbs have free end portions. A continuous cable is provided for flexing the pair of limbs. Eccentric wheel mechanisms are attached to the free end portions of the limbs for movably supporting the cable. The eccentric wheel mechanisms each have a peripheral surface. A plurality of slots extend radially through the peripheral surface. The continuous cable has a first cable portion extending between the eccentric wheel mechanisms for receiving the arrow. The first cable portion has a pair of end portions. A second cable portion and a third cable portion each inclue a first end, a second end and an intermediate portion between the first and second ends. The first ends are connected to the pair of end portions of the first cable portion, respectively. The second ends are connected to the pair of limbs, respectively. The second and third cable intermediate portions each are arranged to pass through a selected slot of the respective eccentric wheel mechanism and thereafter extend around a portion of the peripheral surface of the eccentric wheel mechanism to thereby control the amount of intermediate cable portion positioned on the peripheral surface to provide a preselected draw length of the first cable portion.

Further, in accordance with the present invention, the second and third cable intermediate portions are each arranged to pass through a selected slot in the eccentric wheel mechanism and thereafter extend around a portion of the peripheral surface of the eccentric wheel mechanism to thereby control the amount of the intermediate cable portion positioned on the peripheral surface to permit adjustments in the draw weight of the bow.

A further feature of the present invention includes eccentric wheel mechanisms attached to the free end portions of the limbs for movably supporting the continuous cable. The eccentric wheel mechanisms have an eccentrically positioned axis of rotation on the free end portions of the limbs. Eccentric adjustment devices are provided for adjusting the position of the axis of rotation of the eccentric wheel mechanisms relative to the free end portions of the limbs to vary the draw weight and draw length of the bow.

Further, in accordance with the present invention, the handle member includes a cavity and the second and third cable portions are arranged to pass in overlying relation through the cavity. Cable support devices positioned in the cavity are operable to support the second and third cable portions in the cavity so that the second and third cable portions are removed from contact with the arrow when the arrow is released from the bow.

An additional feature of the present invention includes a compound bow for propelling an arrow having a handle member for gripping the bow. A pair of limbs extend outwardly from opposite ends of the handle member for storing energy to propel the arrow. The pair of limbs have free end portions. A continuous cable is provided for flexing the limbs. Eccentric wheel mechanisms are attached to the free end portions of the limbs for movably supporting the cable. Adjustment means are provided for pivotally connecting the pair of limbs to the handle member to thereby permit adjustments in the flex of the limbs. The adjustment devices each include an arrangement for relaxing the limbs on the handle member while maintaining the limbs engaged to the handle member.

Further, in accordance with the present invention, there is provided apparatus for rotatably supporting a cable of a compound bow that includes a pulley. The pulley has a rim portion. A first annular groove is provided on the periphery of the rim portion and receives a first portion of the cable reeved about the pulley. A second annular groove is provided on the periphery of the rim portion and is arranged to receive a second portion of the cable reeved about the pulley. The second annular groove is laterally spaced from the first annular groove. A first set of circumferentially spaced slots extend radially through the rim portion and into the first annular groove. A cable passage, such as a hole or a slot, is positioned oppositely of the first set of circumferentially spaced slots and extends radially through the rim portion and into the second annular groove. The cable passage is arranged to receive the cable extending through a selected one of the slots of the first set of slots to thereby transfer the cable from the first annular groove to the second annular groove so that the amount of cable positioned on the rim portion is adjustable.

Accordingly, the principal object of the present invention is to provide a compound bow for propelling an arrow in which the cable portions are rotatably supported at the free end portions of the limbs by eccentric wheel mechanisms that are operable to permit a plurality of adjustments in the draw length of the portion of the cable that receives the arrow and the draw weight of the bow corresponding to a preselected draw length.

Another object of the present invention is to provide for compound bow eccentric wheel mechanisms that are adjustable to effect a change in the draw weight of the bow without repositioning the cable portions on the eccentric wheel mechanisms.

A further object of the present invention is to provide a compound bow with a handle member having a cavity in which are positioned idler pulleys for supporting portions of the cable in a position removed from contact with the arrow during the drawing and shooting cycle and also provides an arrangement for balancing the forces exerted upon the limbs of the bow when the cable is drawn.

An additional object of the present invention is to provide an adjustment device for pivotally connecting the limbs of a compound bow to the handle member to permit adjustments in the flexure of the limbs and support the limbs in a relaxed position on the handle member but prevent the limbs from becoming disengaged from connection with the handle member.

Also, an object of the present invention is to provide a novel pulley for adjusting the tension in the cable of a compound bow to effect a plurality of adjustments in the draw length and the draw weight of the bow.

These and other objects of the present invention will be more completely disclosed and described in the following specification, the accompanying drawings and the appended claims.

BRIEF DESCRIPTION OF THE DRAWINGS

FIG. 22 is a fragmentary view partially in section of a second embodiment of the limb adjustment mechanism of the present invention.

FIG. 23 is a fragmentary view partially in section taken along line XXIII—XXIII of FIG. 22.

FIGS. 24–26 are fragmentary views partially in section similar to FIG. 22, illustrating relative pivoted positions of the limb on the handle.

FIG. 27 is also a fragmentary view partially in section, illustrating the adjustment bolt removed and the limb supported in a relaxed position on the handle.

DESCRIPTION OF THE PREFERRED EMBODIMENTS

Figure 1:
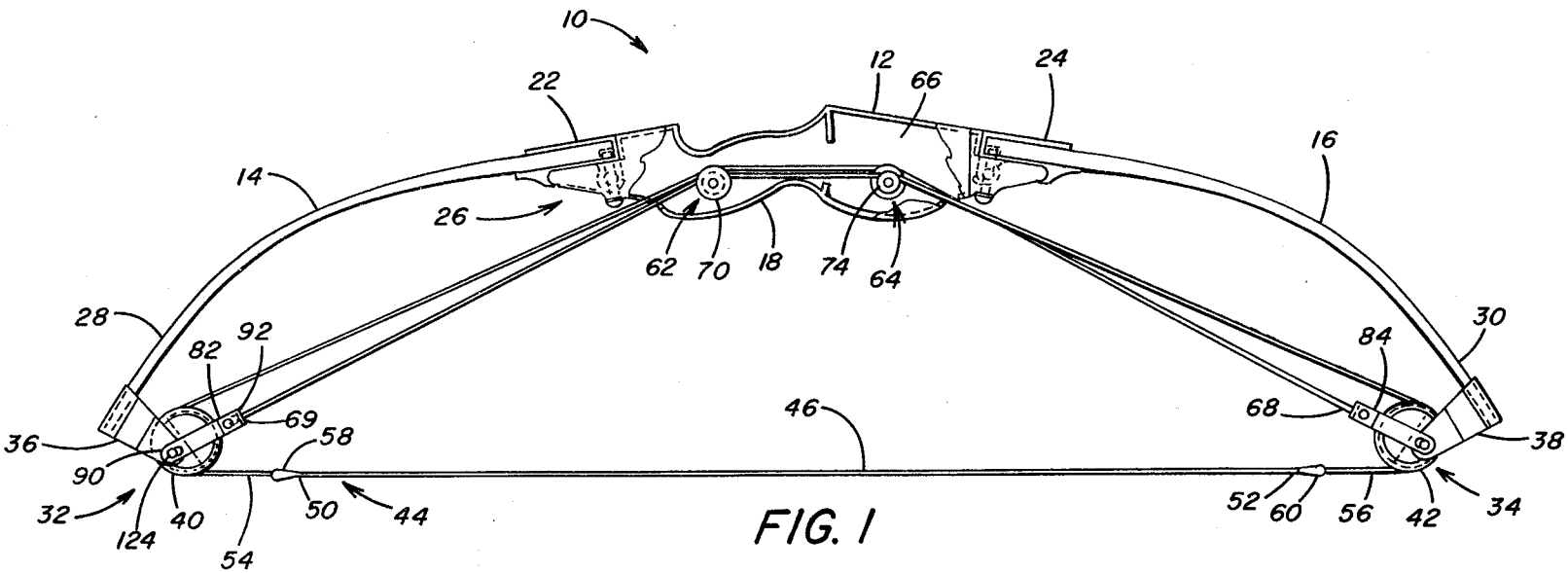
FIG. 1 is a fragmentary view in side elevation of a compound bow, illustrating a handle for supporting a pair of idler pulleys to support the cable in a position removed from contact with the arrow when mounted on the bow and eccentric pulleys rotatably positioned on the ends of a pair of limbs for adjusting the cable tension and the draw length of the cable.
Figure 2:
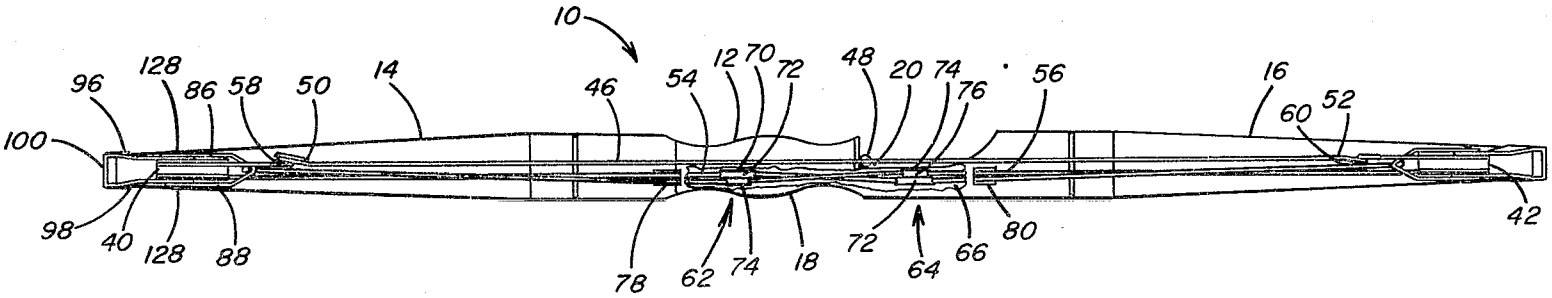
FIG. 2 is a rear view of the compound bow shown in FIG. 1, illustrating portions of the cable supported by the idler pulleys in a position displaced laterally from a sight window of the bow.

Referring to the drawings and particularly to FIGS. 1 and 2 there is illustrated a compound bow generally designated by the numeral 10 having a handle member 12 and a pair of limbs 14 and 16. The handle member 12 includes a grip portion 18 and a sight window 20. The handle member 12 also includes opposite end portions 22 and 24. The limbs 14 and 16 are connected to the handle member end portions 22 and 24, respectively in a manner to permit the limbs 14 and 16 to pivot about their connections to the handle member 12. This arrangement permits adjustment in the flexure of the limbs. Limb adjustment devices generally designated by the numeral 26 pivotally connect the ends of the limbs to the handle member end portions 22 and 24. The limb adjustment devices 26 are operable, in a manner to be explained hereinafter in greater detail, to permit the limbs 14 and 16 to pivot about the handle member end portions 22 and 24 so that free end portions 28 and 30 of the limbs may be either moved further apart or closer together to vary the flexure of the limbs.

A pair of eccentric wheel and cable mounting assemblies generally designated by the numerals 32 and 34 are secured to the limb free end portions 28 and 30 respectively. The mounting assemblies 32 and 34 include brackets 36–38 respectively which are rigidly secured to the limb free end portions 28 and 30 and are operable to rotatably and eccentrically support a pair of eccentric wheel mechanisms, such as pulleys 40 and 42. A continuous cable 44 is reeved about the pulleys 40 and 42 in a preselected arrangement as will be explained later in greater detail to permit a plurality of adjustments in the draw length and draw weight for the pair of pulleys 40 and 42 of a preselected diameter.

The continuous cable 44, as illustrated in FIG. 1, includes a first portion or arrow string portion 46 that extends between the pulleys 40 and 42 for receiving the arrow 48 which is supported on the sight window 20, as illustrated in FIG. 2. The arrow string 46 includes end portions 50 and 52 which are suitably connected to cable portions 54 and 56 at end portions 58 and 60 thereof, respectively. The cable portion 54 is reeved about the eccentric pulley in a preselected manner corresponding to a preselected draw length and draw weight of the bow and is supported at its intermediate portion by idler pulleys 62 and 64 positioned in a cavity 66 of handle member 12. The cable portion 54 is connected at an opposite end 68 to the mounting assembly 34 on the free end portion 30 of limb 16. In a similar fashion, cable portion 56 is reeved about the eccentric pulley 42 in an arrangement corresponding to the manner in which the cable portion 54 is reeved around the eccentric pulley 40 so that the pulleys 40 and 42 are synchronized. From the pulley 40, the intermediate portion of cable portion 56 extends over the cable portion 54 and around pairs of idler pulleys 62 and 64 in the cavity 66 of handle member 12 and is connected at an opposite end portion 69 to the mounting assembly 32 on the free end portion 28 of the limb 14.

The idler pulleys 62 and 64 are rotatably supported in a conventional manner in the cavity 66 of the handle member 12. Each pair of pulleys includes a large diameter pulley 70 having a peripheral groove 72 and a small diameter pulley 74 having a peripheral groove 76 where the large and small diameter pulleys are coaxially mounted in pairs to enable the cable portions extending through the handle to cross in overlying relation. The cable portion 56 is supported by the small diameter pulley 74 of each pair of pulleys 62 and 64, and the cable portion 54 is supported by the large diameter pulley 70 of each pair of pulleys 62 and 64.

In order to extend the respective cable portions through the cavity 66 and handle member 12, the handle member 12 includes openings 78 and 80 adjacent the handle end portions 22 and 24 to permit the cable portions to enter the cavity 66 and extend over the pair of idler pulleys 62 and 64. With this arrangement, the respective cable portions are removed from contact with the arrow so as not to interfere with the shaft of the arrow or the fletching of the arrow when it is released from the arrow string portion 46. By extending the cable portions 54 and 56 in overlying relation through the handle member 12, the need for auxiliary cable supporting devices mounted externally on either the handle member 12 or the limbs 14 and 16 is eliminated with the present invention.

The cable end portions 69 and 68 are connected to the respective mounting brackets 36 and 38 by harness brackets 82 and 84 respectively. Each harness bracket includes a bifurcated portion that is formed by a pair of arm members 86 and 88 (shown in FIG. 2) that are spaced from one another at a first end 90 and connected to one another at a second end 92. The second end 92 includes an opening 91 for receiving the enlarged end portion of the respective cable. When the cable is mounted on the pulleys and tensioned, the cable end portion remains engaged with the harness bracket end portion 92.

Figure 19:
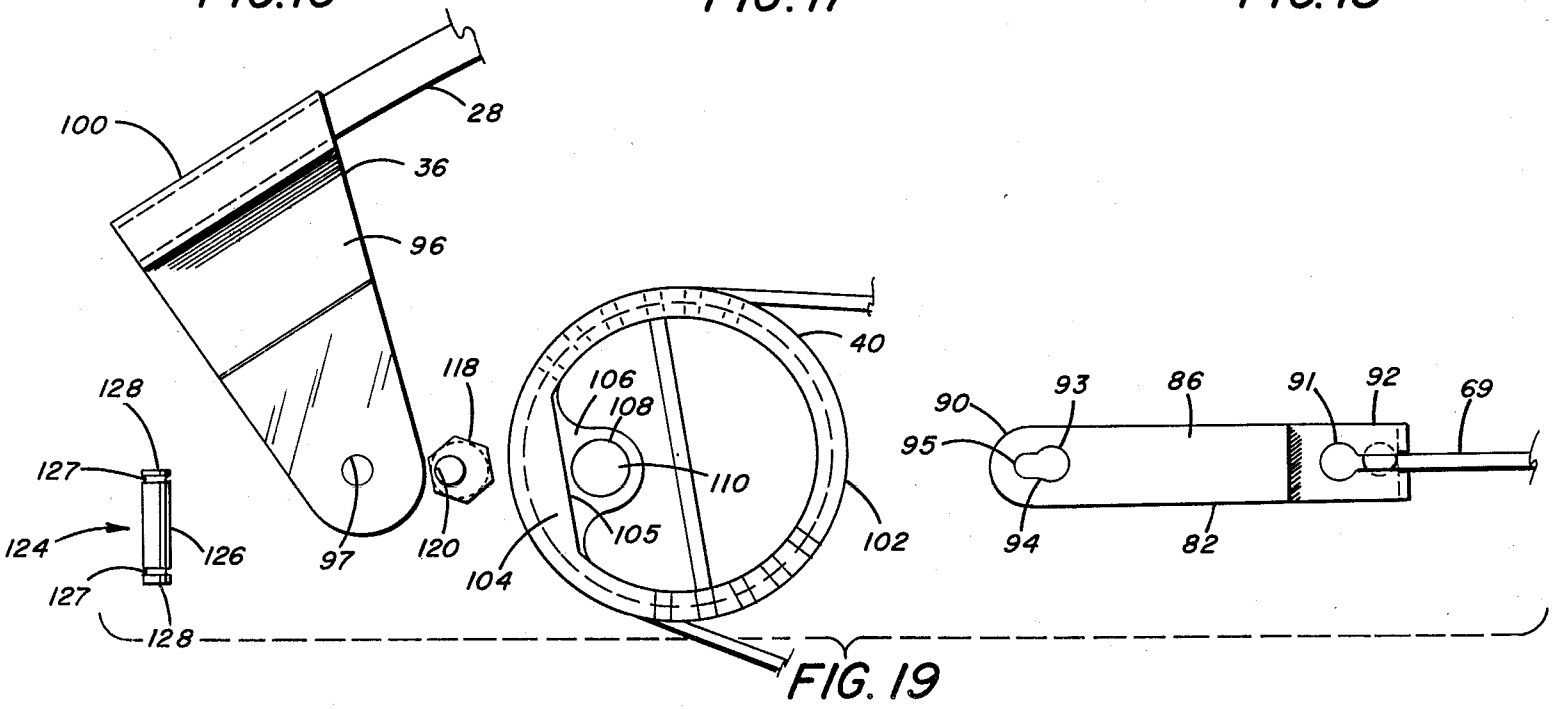
FIG. 19 is an exploded view of the arrangement for releasably securing a pulley and cable end portion to a mounting bracket of a limb.

As illustrated in greater detail in FIG. 19, the first end 90 of each harness bracket arm member 86 and 88 includes a bore 94 having an enlarged diameter portion 93 and a reduced diameter portion 95. The bifurcated portion of the harness brackets 82 and 84 are positioned in surrounding relation with the respective mounting brackets 36 and 38. The mounting brackets 36 and 38 each include spaced apart flange portions 96 and 98 connected by a body portion 100, which is suitably secured to the free end portion of a respective limb. The flange portions 96 and 98 include aligned bores 97, which in the assembled bow are positioned in underlying relation with the bores 95 extending through the end portions 90 of harness brackets 82 and 84. Positioned between the mounting bracket flanges 96 and 98 are the pulleys 40 and 42 respectively.

Figures 3, 4, 5, 6, 7, 8, 9, 10:
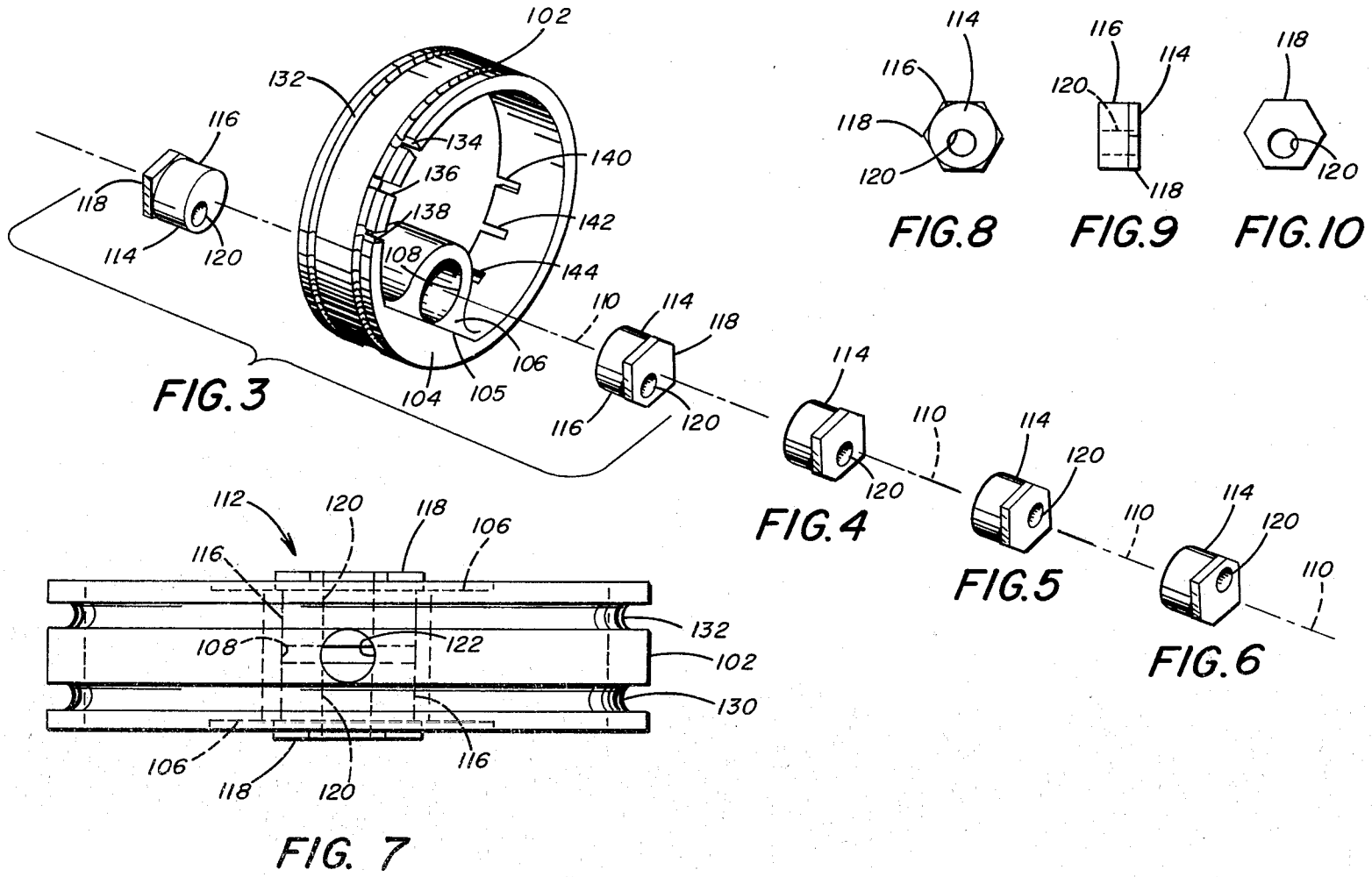
FIG. 3 is an isometric exploded view of one of the eccentric pulleys for supporting the cable on the end of a limb, illustrating the eccentric adjustment device for adjusting the draw weight of the bow.
FIGS. 4–6 are isometric views of one-half of the eccentric adjustment device, illustrating various positions of the eccentric adjustment device for effecting variations in the maximum energy stored and the force required to maintain the arrow in the full draw position by changing the position of the eccentric axis of rotation of the pulley.
FIG. 7 is a view in side elevation of an eccentric pulley, illustrating the eccentric adjustment device assembled in the eccentric bore of the pulley.
FIGS. 8–10 are front, side and rear views repectively of one-half of the eccentric adjustment device illustrated in FIG. 7.

A representative pulley is illustrated in FIGS. 3, 7 and further in FIGS. 11–19. Each of the pulleys 40 and 42 has an annular body portion with a rim 102 having a portion 104 extending from the rim so that each pulley is substantially hollow and has a ring-like configuration. Unlike conventionally known pulleys which are substantially solid or provided with spokes extending from a central hub to the rim of the pulley, the pulleys of the present invention are spokeless and substantially hollow. A minimum body portion 104 extends from the rim 102 and thereby reduces the weight of the pulley. This arrangement improves the shooting performance of the compound bow 10 by providing a minimum mass at the ends of the limbs 14 and 16.

The portion 104 has a recess 106 and a shoulder or abutment 105 extending upwardly therefrom. A bore 108 extends through the portion 106 and has an axis 110 that is off-set from the geometric axis of the pulley. The pulleys 40 and 42 are positioned between the flanges 96 and 98 of the mounting brackets 36 and 38 so that the bores 97 of the flanges are aligned with the eccentric bore 108 of the respective pulleys. During assembly of the bow the harness bracket arm members 86 and 88 are positioned so that the arm member bore portions 93 are aligned with the respective pulley bore 108 and the mounting bracket bores 97.

The bore 108 of each pulley 40 and 42 is arranged to rotatably receive an eccentric adjustment device generally designated by the numeral 112 that includes a pair of hex-shaped shoulder bushings 114 illustrated in FIGS. 8–10. Each bushing 114 includes a cylindrical portion 116 and a hexagonal head 118 extending from one end of the cylindrical portion. A bore 120 extends through the cylindrical portion 116 and the hexagonal head 118. The axis of the bore 120 is off-set or eccentrically positioned relative to the longitudinal axis of the cylindrical portion 116 to form the eccentric axis of rotation of the respective pulley.

In their assembled position in the bore 108 of a respective pulley, the cylindrical portions 116 enter the bore 108 from opposite ends with the hexagonal heads 118 positioned in abutting relation with the shoulders 105 on the hub recessed portions 106. In this arrangement the axis of the bore 120 is eccentrically positioned relative to the axis 110 of the bore 108. The bushings 114 are rotatable in the bore 108, and FIGS. 4–6 illustrate the 4, 5 and 6 o'clock positions to which a bushing may be rotated in the bore 108. The bushing also may be rotated to 10 and 8 o'clock positions which are not shown. With this arrangement adjustments in the draw weight of the bow can be made, as will be later explained in detail. As illustrated in FIG. 7, when positioned in the pulley bore 108, the cylindrical portions 116 are positioned in spaced relation. A bore 122 extends transversely through the pulley rim 102 into the bore 108 of the body portion 104. By inserting a suitable tool, such as the blade of a screwdriver, into the bore 122 and between the spaced end portions of the cylindrical portions 116 and by rotating the tool, the bushings 114 are moved out of the bore 108 in a manner to facilitate removal from the bore 108.

The pulleys 40 and 42 and harness brackets 82 and 84 are maintained in assembled relation on the mounting brackets 36 and 38 by an axle 124, illustrated in FIG. 19, that extends through the aligned bores 97, 95 and 108 of the respective mounting bracket, harness bracket and the pulley. Each axle 124 includes a central portion 126 that is positioned in the bore 120 of each eccentric bushing 114. End portions 128 of each axle 124 are spaced from the central portion 126 by a circumferential groove 127 that is arranged to receive the edge of the harness bracket arms 86 and 88 surrounding the bore 95 therethrough.

With this arrangement in assemblying the pulleys 40 and 42 and the harness brackets 82 and 84 on the mounting brackets 36 and 38, the enlarged diameter portion 93 of the harness bracket bores 94 is positioned in alignment with the respective bores 120 and 97 of the pulleys and mounting brackets. The axle 124 has a diameter which permits it to advance through the enlarged diameter portion 93 of the harness bracket bores. When the axle 124 is in position in the aligned bores the tension on the end portion of the respective cable acts to maintain the reduced diameter portions 95 of the bore 94 in surrounding relation with the axle grooves 127. Because the diameter of the axle central portion 126 is greater than that of the reduced diameter portion 95 of the bores 94, the axle 124 is retained in the aligned bores. Thus with this arrangement the mounting brackets, harness brackets and pulleys are retained in assembled relation on the free ends of the limbs without the need of conventionally known clips, snap rings and the like. These conventionally known devices increase the difficulty of replacing the pulleys on the limbs of the bow. Further in accordance with the present invention, the bores 97 of the mounting bracket flanges 96 and 98 also are adaptable to have an enlarged and a reduced diameter portion similar to bore 94 of brackets 82 and 84 to facilitate mounting of the pulleys on the brackets 36 and 38.

Each pulley 40 and 42 includes a first annular groove 130 on the rim 102 and a second annular groove 132 on the rim in which the annular grooves are in spaced relation. A first set of circumferentially spaced slots 134, 136, 138 extend radially through the rim 102 into the first annular groove 130. Diametrically positioned opposite the first set of circumferentially spaced slots is a second set of circumferentially spaced slots 140, 142, 144 extending radially through the rim portion and into the second annular groove 132. The respective sets of circumferentially spaced slots serve as passageways for connecting the annular grooves 130 and 132.

Figure 11:
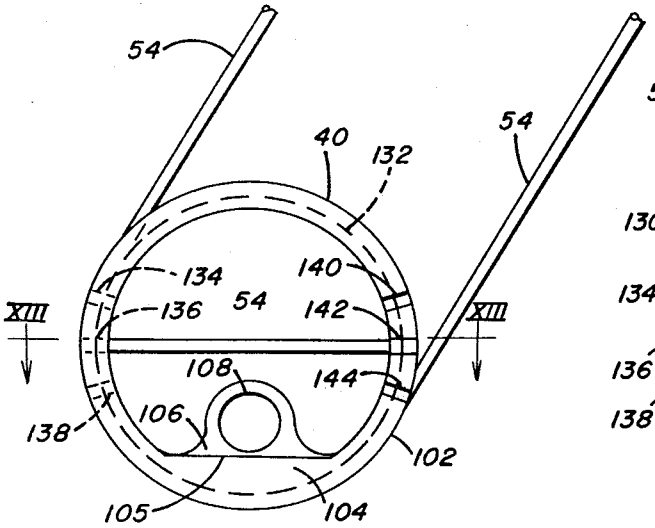
FIG. 11 is a top plan view of an eccentric pulley, illustrating a first and second set of slots oppositely positioned on the rim portion for receiving the portion of the cable wound around the pulley in an arrangement to permit adjustments in the length of cable wound around the pulley.
Figure 13:
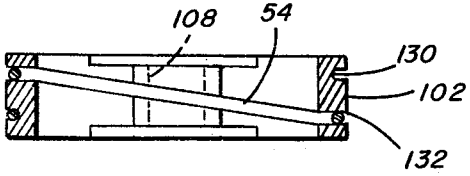
FIG. 13 is a sectional view of the eccentric pulley taken along line XIII—XIII of FIG. 11, illustrating passage of the cable between the annular grooves.

For example, as illustrated in FIG. 11, cable portion 54 extends from the cavity 66 in handle 12 onto the annular groove 130 and extends through the slot 136 and passes therefrom through the center of the pulley 40 into the opposite slot 142 opening into annular groove 132. With this arrangement the cable is transferred from groove 130 to groove 132 and extends from slot 142 in a counterclockwise direction around the rim 102 in groove 132 less than one complete revolution of the pulley before it extends from the pulley.

Figure 15:
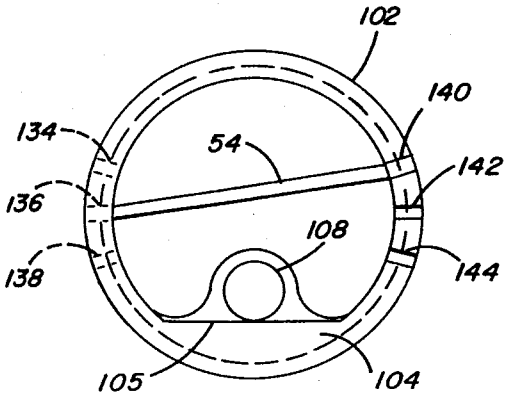
FIGS. 14 and 15 are top plan views of an eccentric pulley, illustrating the cable positioned in selected slots of the pulley to provide a preselected length of cable wound around the pulley corresponding to a preselected draw weight.
Figure 14:
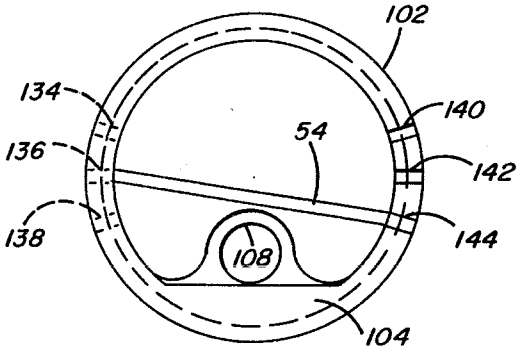
Figure 12:
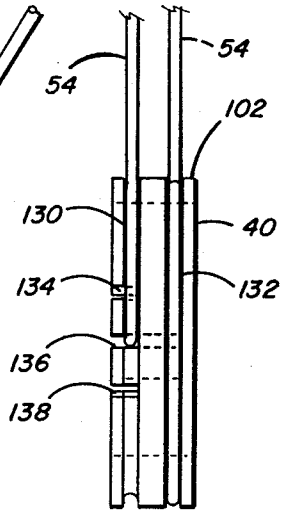
FIG. 12 is a view in side elevation of the eccentric pulley shown in FIG. 11, illustrating the annular grooves on the periphery of the pulley and the cable extending through a selected pair of slots for transferring the cable from the first groove to the second groove.

The path which the cable follows around the pulley determines the amount of cable that is wound around the pulley. By extending the cable through selected slots as illustrated in FIG. 15 where the cable passes through slots 136 and 140, the length of cable wound around the pulley is adjustable. By moving the cable from slot 140 to slot 142 the length of cable wound around the pulley is changed. In a similar manner, by extending the pulley through slots 136 and 144, as illustrated in FIG. 14, a further adjustment in the length of the cable surrounding the pulley is made. Thus, by adjusting the length of cable wound around the respective pulleys, the draw length and draw weight of the bow may be selectively adjusted without requiring a change in the size of the eccentric pulley.

Increasing the length of cable reeved about the eccentric pulleys, decreases the draw length of the arrow string portion 46 and the draw weight of the bow. Thus with the present invention, a preselected draw length is provided by advancing the cable around the annular grooves 130 and 132 and positioning the cable in slot 136 on groove 130 and slot 142 on groove 132. With the cable in this position, a draw length for example of 29 inches is provided for a draw weight of 45 pounds. If a change in the draw weight is desired while maintaining a constant draw length of 29 inches, the cable may be wound on the pulley to extend through slot 138 as illustrated in FIG. 14 so that the draw weight is increased to 49 pounds, or extended through slot 134 as illustrated in FIG. 15 where the draw weight is decreased to 41 pounds. This arrangement is particularly advantageous when the compound bow is used in one application for hunting where a greater draw weight is preferred or in another application for competitive target shooting where a lesser draw weight is preferred.

Accordingly, by changing the position of the cable in the second set of slots, the draw length can be changed. For example, by moving the cable to extend through slot 144 instead of slot 142 the draw length can be reduced from 29 inches to 28 inches. In addition, if an increase in draw length is desired the cable may be moved to slot 140 for a draw length of 30 inches. Then once the cable is positioned in a selected one of the slots 140, 142 or 144, the draw weight for that selected draw length can be adjusted by positioning the cable in one of the slots 134, 136 or 138 of the first set.

In addition, provision is made for adjusting the draw weight of the bow to a further degree without changing the position of the cable in the respective sets of slots. This is accomplished by the eccentric adjustment device 112 as diagrammatically illustrated in FIGS. 16–18. By rotating the hexagonal head 118 of the members 114, the position of the eccentric axis of rotation of the pulley on the limb is changed. Accordingly, a change in the position of the eccentric axis of rotation of the pulley on the limb changes the stiffness or flexure of the limb, and accordingly the amount of energy that can be stored in the limb when the arrow string portion 46 of the cable is drawn.

Figure 16:
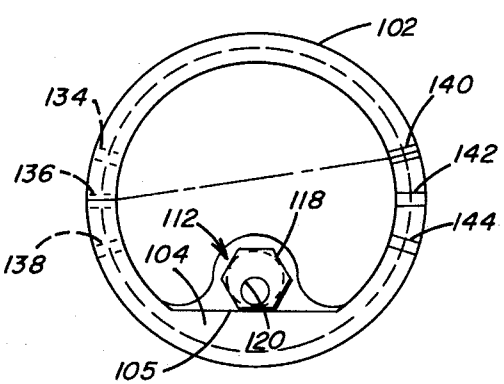

As illustrated in FIG. 16, the eccentric bore 120 is in the position corresponding to 6 o'clock to provide a preselected draw weight corresponding to the position of the cable in the slots 136 and 140. By rotating the hex head 118 from the 6 o'clock position of FIG. 16 to the 12 o'clock position of FIG. 17, the position of the eccentric bore 120 is changed resulting in a change of position of the eccentric axis of rotation of the pulley on the limb. Preferably, this has the affect of decreasing the draw weight of the bow from the bow weight corresponding to the location of the cable in slots 136 and 140. Further rotation of the hex head 118 from the 12 o'clock position of FIG. 17 to the 8 o'clock position illustrated in FIG. 18 increases the draw weight by moving the eccentric axis of rotation of the pulley closer to the free end portion of the limb. It should be understood that the 8 o'clock position on eccentric pulley 40 corresponds to the 4 o'clock position on eccentric pulley 42. Therefore, the adjustment in the eccentric axis of rotation of the pulleys 40 and 42 must be synchronized.

Figure 18:
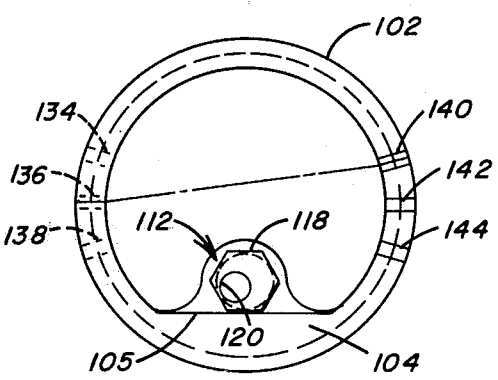
FIGS. 16–18 are top plan views of an eccentric pulley, illustrating the eccentric axis of rotation of the pulley in a preselected position as determined by the position of the eccentric adjustment device in the bore of the pulley for a preselected draw weight.
Figure 17:
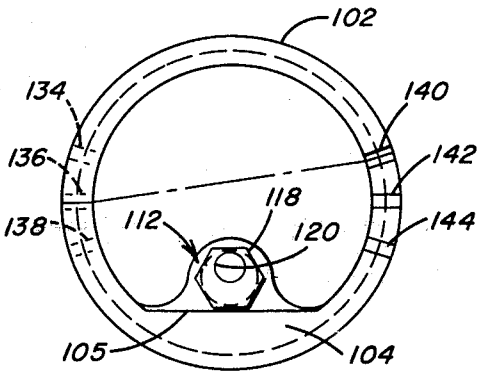

In making the adjustment from the 6 o'clock position to the 12 o'clock position the eccentric axis of rotation of the pulley was moved away from the free end portion of the limb. This adjustment decreases the tension in the limbs to provide a corresponding decrease in the draw weight. By moving the eccentric axis toward the free end portion of the limb, as illustrated in FIG. 18, the tension in the limb is increased resulting in an increase in the draw weight. In each position the bushing 114 is locked in position by abutting engagement of the hex head 118 with the shoulder 105 of the respective pulley.

Thus with the eccentric adjustment device 112 of the present invention a plurality of adjustments in the draw weight of a compound bow may be obtained for a given draw length. Furthermore, the adjustments may be made without requiring replacement of the pulleys of one diameter size for pulleys of another diameter size on the limbs of the bow. When the features of the eccentric adjustment device 112 are combined with the adjustments in the length of cable wound around the pulleys, a plurality of adjustments in the draw weight may be made for a preselected draw length or adjustments in the draw length may be made without replacing pulleys on the limbs.

Figure 20:
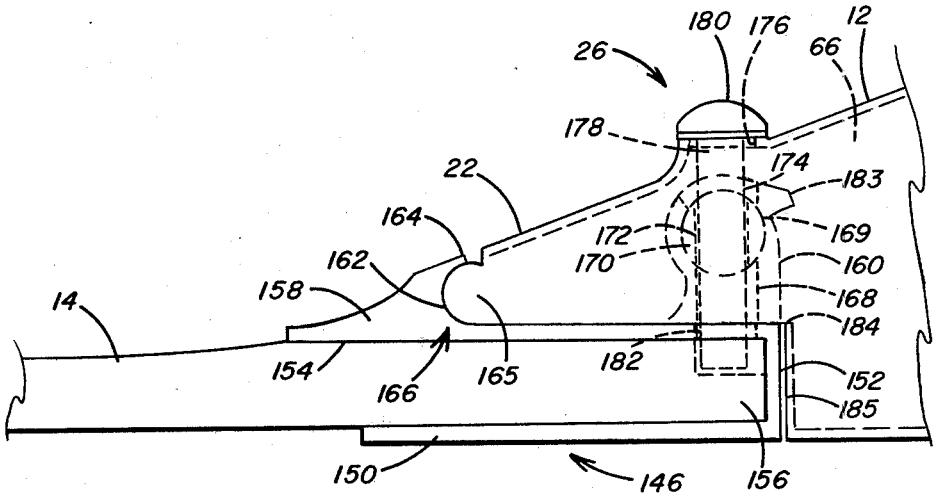
FIG. 20 is a fragmentary view in side elevation of the limb adjustment mechanism for pivotally connecting a limb to the handle member, illustrating the limb secured in a cocked position on the handle member.
Figure 21:
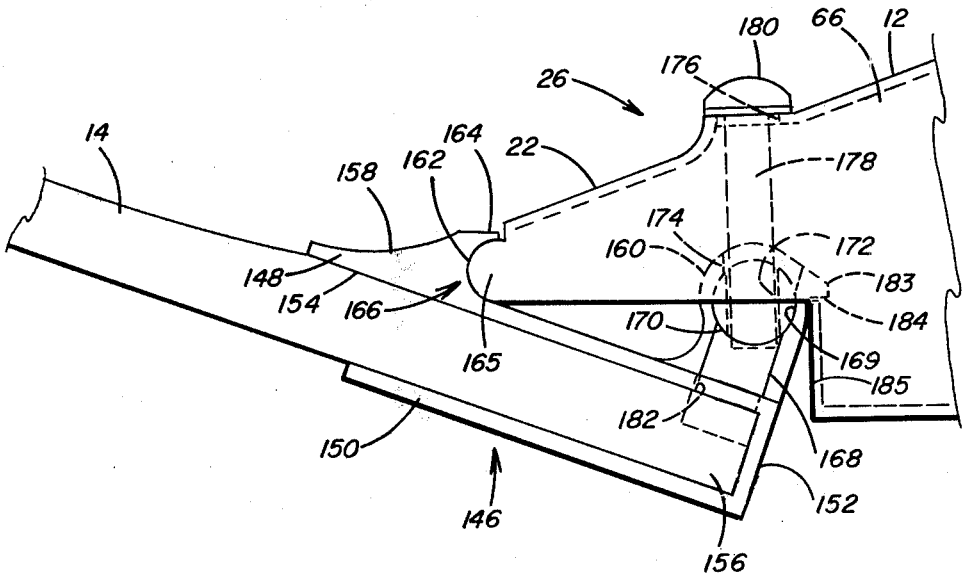
FIG. 21 is a view similar to FIG. 20, illustrating the limb in an uncocked position on the handle member and secured thereto to prevent disengagement from the handle member.

Referring to FIGS. 20 and 21 there is illustrated in detail one of the limb adjustment devices 26 for pivotally connecting a respective limb 14 to the respective handle end portion 22 in a manner to permit adjustments in the flexure of the limb and to maintain the limb connected to the handle member when the limb is relaxed on the handle. The limb adjustment device, as illustrated in FIG. 20, where the limb 14 is positioned in a fully flexed or cocked position on the handle member 12 includes a limb pivot plate 146 formed by upper and lower spaced parallel members 148 and 150 connected by a vertical member 152. This arrangement forms a longitudinal recess 154 for receiving the end portion 156 of limb 14 where the members 148 and 150 abut the surfaces of the limb and the end portion 156 abuts the vertical member 152.

A shoulder 158 extends outwardly from one end portion of member 148 and a hinge bracket 160 extends inwardly from the opposite end portion of member 148. The shoulder 158 includes an arcuate recess 162 that terminates in a lip 164. The recess 162 receives an arcuate end 165 of handle member 12 and thus forms a pivot point generally designated by the numeral 166 of the limb on the handle member. The flange 160 opposite the shoulder 158 has an opening 168 extending therethrough. The opening 168 has an arcuate portion 169, and a cylindrical member 170 is rotatably positioned in the arcuate portion 169. The member 170 includes a transverse threaded bore 172 that is aligned with a transverse bore 174 extending through hinge bracket 160 when the member 170 is positioned in the arcuate portion 169.

The hinge bracket 160 extends into the cavity 166 of the handle member 12 below the end 165 thereof. The bracket 160 has a transverse dimension less than the width of the cavity 66 to permit pivotal movement of the bracket 160 into and out of the cavity 66. The bracket 160 is positioned, as illustrated in FIG. 20, oppositely of a hole 176 that extends through the handle member 12 and is arranged to receive a draw weight adjustment screw 178. The screw 178 has an enlarged end portion 180 that seats on the outer surface of the handle member 12 surrounding the bore 176. The screw 178 extends through the hole 176 and bore 174 and is threadably engaged only to bore 172 in portion 170. In the cocked position of FIG. 20, the end of the screw 178 extends through an aperture 182 of pivot plate member 148 and is spaced from the notched end portion 156 of limb 14 between the members 148 and 150.

To adjust the draw weight of the bow by relaxing the limbs 14 and 16 on the handle member 12, which has the affect of reducing the flexure of the limbs, the screw end portion 180 is rotated to permit the limb to pivot about the pivot point 166 on the end of the handle member 12. As the screw 178 is rotated, the end portion 180 remains fully seated on handle member 12, and the member 170 advances down the shaft of the screw 178 to permit the end of the limb 14 to pivot away from the handle member 12, as illustrated in FIG. 21. As the limb 14 pivots on the handle member 12, the vertical member 152 and hinge bracket 160 move downwardly relative to shoulder 184 and vertical edge 185 of the handle member without interference therewith. Accordingly, by selectively rotating the screw head 180 the flexure of the limb is varied corresponding to a preselected draw weight of the bow. With this arrangement the draw weight of the bow is efficiently adjusted. It will be apparent with the present invention that the adjustment in flexure of one limb is synchronized with the adjustment in flexure of the opposite limb.

In the relaxed position of the limb on the handle member, as illustrated in FIG. 21, the limb is prevented from becoming completely disengaged from the handle member 12 by provision of a shoulder 183 which extends from the hinge bracket 160. In the relaxed position of the limb on the handle member, shoulder 183 engages a shoulder 184 of the handle member. This permits the limbs to be relaxed for facilitating adjustments. As the screw 178 is rotated, it progressively moves out of aperture 182 as the limb pivots around pivot point 166 and the hinge bracket 160 rotates about cylindrical member 170. Thus the limb will pivot as the screw 178 is rotated in the member 170 until shoulders 183 and 184 are in abutting relation. In this manner the flexure of the limbs is safely adjusted to adjust the draw weight of the bow without the possibility of the limbs springing from the handle member and injuring the operator or damaging the bow.

The second embodiment of the limb adjustment devices of the present invention is illustrated in FIGS. 22–27 and is generally designated by the numeral 186. For purposes of convenience of illustration and description, like numerals used for FIGS. 20 and 21 refer to like parts in FIGS. 22 and 27. Referring to FIG. 22 there is illustrated a handle member 12 of a preselected configuration which is distinguished from the configuration of the handle member 12 illustrated in FIGS. 20 and 21. The configuration of the handle member 12 is chosen in accordance with the aesthetic design of the bow; therefore, it should be understood that the handle design is not a critical feature of the present invention and is not considered a limitation thereof.

The limb 14 is positioned in FIGS. 22 and 23 in a fully flexed or cocked position on the handle member 12 where the surface 188 of the limb is positioned flush with housing 190 of the handle member 12. The housing 190 includes a cavity 192 and a shoulder 194 positioned within the cavity 192 and adjacent the limb end 156 when the limb is in the fully flexed position on the handle member 12. The limb 14 is pivotally supported on the handle member 12 by a half round member 196 secured to the limb upper surface 189 and received within a recess 198 of the end 165 of handle member 12. With this arrangement the limb 14 is operable to pivot about the pivot point 166 relative to the handle member 12 as the flexure of the limb is adjusted.

A pivot plate generally designated by the numeral 200 is secured to the end 156 of limb 14 by a screw 202 which extends through an opening 203 of the limb and into the cavity 192. The plate 200 has a first portion 204 recessed in the surface 188 of limb 14 and a second portion 208 extending at substantially a right angle to the first portion 204 so as to extend around the limb end 156 and into the cavity 192. A shoulder 120 extends outwardly from the upper edge of the second portion 208 in overlying relation with housing shoulder 194. In the relaxed position of the limb 14 on the handle member 12, as illustrated in FIG. 27, the limb is no longer flexed but remains secured to the handle member 14 by the abutting relation of plate shoulder 210 with housing shoulder 194. This prevents complete disengagement of the limb from the handle member as above described for FIG. 21 and the possibility of damage to the bow and injury to the operator if a flexed limb became disengaged from the handle member.

The position of the limb 14 on the handle member 12 is selectively adjusted between the fully flexed position illustrated in FIG. 22 and the unflexed or relaxed position of FIG. 27 to vary the flexure of the limb and accordingly the draw weight and draw length of the bow. FIGS. 24, 25 and 26 illustrate intermediate pivoted positions of the limb for a flexure of the limb between a full flex and a relaxed limb.

In each pivoted position of the limb, corresponding to a preselected draw weight of the bow, the limb 14 is securely supported on the handle member 12 by a limb support mechanism generally designated by the numeral 212. The mechanism 212 includes an abutment member, such as the block 214 illustrated in FIGS. 22–27, and stub shafts 216 that extend outwardly from a pair of opposite faces 211 and 213 of the block 214. The stub shafts include threaded bores 218 each arranged to receive a threaded member, such as socket head screws 220. The screws 220 are arranged to pass through bores 222 in the handle member housing 190 and into threaded engagement with the respective bores 218. As illustrated in FIG. 22, the longitudinal axis of the stub shaft bores 218 is eccentrically positioned relative to the geometric center of the block 214. In this manner the block 214 is supported in the housing cavity 192 for movement about an eccentric axis of rotation to position the block 214 in a preselected eccentric position on the handle member 12.

The block 214 also includes planar surfaces 224, 226, 228 and 230 positioned at right angles relative to one another in which the surfaces are operable as supporting surfaces for the limb 14 in a preselected pivoted position of the limb. Threaded bores 232 and 234 extend through the block and the opposite pairs of surfaces 224, 228 and 226, 230 respectively. The bores 232 and 234 intersect and are offset from the geometric center of the block. The screw 202 is arranged to threadedly engage one of the bores 232 or 234 depending on the selected pivoted position of the limb and thereby maintain the block in a preselected eccentric position so that a selected one of the block surfaces abuts the surface 189 of the limb.

In operation to position the limb in a preselected pivoted position, the screw 202 is removed from engagement with the block and the block is rotated by turning one of the socket head screws 220 until a selected one of the block surfaces is positioned oppositely of the limb surface 189. During this adjustment the limb is retained on the handle member of engagement of the shoulders 194 and 210. Due to the eccentric axis of rotation of the block 214, the faces 224–230 project a preselected distance from the interior of the handle member when positioned opposite the limb. In FIG. 22, the block 214 is positioned so that the limb rests on block surface 224 flush with the handle housing 190.

FIGS. 24, 25 and 26 illustrate the positions of the surfaces 230, 228 and 226 relative to the housing 190 when positioned in abutting relation with the limb. In these positions the end 156 of the limb is pivoted away from abutting relation with the limb but is securely supported by the block 214 to prevent relative movement between the end of the limb and the handle. When a selected block surface is positioned abutting the limb, the screw 202 is fully extended through the limb and into the respective threaded bore 232 or 234 of the block 214 to maintain the selected eccentric position of the block.

With this arrangement the flexure of the limb is adjustable and the limb securely supported in a selected pivoted position on the handle member. Suitable indicia means (not shown) may be provided on the exterior surface of the handle housing to indicate the eccentric position of the block corresponding to a preselected draw weight of the bow. Also by the arrangement illustrated in FIG. 27 the limb may be safely moved to a relaxed position on the handle but maintained connected thereto to facilitate adjustments to the cable on the eccentric pulleys or to the cable adjusting devices 112 as above discussed.

According to the provisions of the Patent Statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A compound bow for propelling an arrow comprising, handle means for gripping the bow, a pair of limbs extending outwardly from opposite ends of said handle means for storing energy to propel the arrow, said pair of limbs having free end portions, continuous cable means for flexing said pair of limbs, eccentric wheel means attached to each of said free end portions of said limbs for movably supporting said cable means, said eccentric wheel means having a peripheral surface, a plurality of slots extending radially through said peripheral surface, said plurality of slots being positioned in circumferentially spaced relation on said peripheral surface to form a first set of slots and a second set of slots, said first set of slots being diametrically positioned oppositely of said second set of slots respectively, said cable means having a first cable portion extending between each of said eccentric wheel means for receiving an arrow, said first cable portion having a pair of end portions, a second cable portion and a third cable portion, said second and third cable portions each having a first end, a second end and an intermediate portion between said first and second ends, said first ends of said second and third cable portions being connected to said pair of end portions of said first cable portion, said second ends of said second and third cable portions being connected to said free end portions of said pair of limbs respectively, and said intermediate portions of said second and third cable portions each being arranged to pass through a selected slot of said first set of slots and therefrom to a selected slot of said second set of slots and thereafter extend around a portion of said peripheral surface of said eccentric wheel means to provide a preselected amount of said cable intermediate portion positioned on said peripheral surface to thereby control the draw weight and draw length of the bow when said first cable portion is drawn.

2. A compound bow as set forth in claim 1 which includes, said second and third cable intermediate portions each being arranged to pass through a selected slot in said eccentric wheel means and thereafter extend around a portion of said peripheral surface of said eccentric wheel means to thereby control the amount of said cable intermediate portion positioned on said peripheral surface to permit adjustments in the draw weight and draw length of the bow.

3. A compound bow as set forth in claim 1 which includes, said handle means having a cavity, a pair of openings extending through opposite ends of said handle means respectively into said cavity, idler pulley means positioned inside said cavity of said handle means for supporting said intermediate portions of said second and third cable portions, said intermediate portions arranged to extend from said respective eccentric wheel means through said pair of openings and into and out of said cavity, and said intermediate portions being supported by said idler pulley means in said cavity and positioned in crossed overlying relation removed from contact with an arrow.

4. A compound bow as set forth in claim 1 which includes, eccentric adjustment means for adjusting the position of said axis of rotation of each of said eccentric wheel means relative to said free end portions of said limbs to vary the draw weight and the draw length of the bow.

5. A compound bow as set forth in claim 4 in which, said eccentric wheel means includes an eccentrically positioned bore, said eccentric adjustment means including a cylindrical portion having a longitudinal axis, said cylindrical portion being positioned in said eccentrically positioned bore of said eccentric wheel means, a bore extending through said cylindrical portion, said bore being eccentrically positioned relative to said longitudinal axis to form an eccentric axis of rotation of said eccentric wheel means, means extending through said bore of said cylindrical portion for rotatably positioning said eccentric wheel means on each of said limbs respectively, and said cylindrical portion being rotatable within said bore of said eccentric wheel means to thereby change the position of said eccentric axis of rotation of said eccentric wheel means on each of said limbs respectively.

6. A compound bow as set forth in claim 1 which includes, first and second bracket means secured to said free end portions of said pair of limbs respectively for rotatably positioning each of said respective eccentric wheel means on said free end portions of said limbs, said first and second bracket means each having a pair of arm members extending in spaced relation from said free end portion of said respective limb, aligned bores extending through said arm members, said arm member aligned bores each having a large diameter portion and a small diameter portion, said eccentric wheel means each having a ring-like configuration with an annular body portion having a bore extending therethrough, said bore of said eccentric wheel means being aligned with said respective bore of each of said arm members, and means operable to pass through said large diameter portions of said aligned bores and be retained in said small diameter portions of said aligned bores for releasably securing said eccentric wheel means of each of said limbs to said first and second bracket means respectively and for connecting said second and third cable portions to said first and second bracket means respectively.

7. A compound bow as set forth in claim 1 which includes, first and second bracket means secured to said free end portions of said pair of limbs respectively for rotatably positioning each of said eccentric wheel means on said free end portions of said limbs, said first and second bracket means each having a pair of arm members extending in spaced relation from said free end portion of said respective limb, aligned bores extending through said arm members, said eccentric wheel means having a body portion with an eccentrically positioned bore extending therethrough, said eccentric wheel means being positioned between said respective bracket means arm members so that said bore of said eccentric wheel means is aligned with said bores of said arm members, harness means for connecting said second and third cable second ends to said first and second bracket means respectively, and said harness means including means extending through said aligned bores of said respective first and second bracket means and said eccentric wheel means for releasably securing said eccentric wheel means to said respective first and second bracket means.

8. A compound bow as set forth in claim 1 which includes, first and second bracket members secured to said free end portions of said pair of limbs respectively for rotatably and eccentrically positioning said eccentric wheel means thereon, said first and second bracket members having bores extending therethrough, a pair of harness brackets, each of said harness brackets having a first end portion secured to said second ends of said second and third cable portions respectively and a bifurcated second end portion, a pair of aligned bores extending through said bifurcated second end portion, said bifurcated second end portion being positioned in surrounding relation with said respective bracket member so that said bores of said bifurcated second end portion are aligned with said bores of said respective bracket member, an axle extending through said aligned bores of said respective bracket member and harness bracket, said axle being operable in a first position in said aligned bores of said bifurcated second end portion to maintain said respective harness bracket attached to said bracket member, and said axle being operable in a second position in said aligned bores of said bifurcated second end portion to pass through said aligned bores to facilitate disengagement of said harness bracket from said respective bracket member.

9. A compound bow as set forth in claim 8 which includes, said pair of aligned bores of said harness bracket bifurcated second end portion, each including an enlarged diameter portion and a reduced diameter portion, said axle being operable when positioned in said enlarged diameter portion of said bores to pass freely therethrough to permit disassembly of said harness bracket from said respective bracket member, and said axle being operable when positioned in said reduced diameter portion of said bores to be restrained from passing therethrough to maintain said harness bracket attached to said respective bracket member.

10. A compound bow as set forth in claim 1 which includes, limb adjustment means for pivotally connecting said limbs to said handle means for adjusting the flexure of said limbs to thereby permit adjustments in the draw weight and draw length of the bow, said limb adjustment means being operable to move said limbs from a fully flexed position to a relaxed position on said handle means, and said limb adjustment means being operable to maintain said limbs engaged to said handle means in said relaxed position.

11. A compound bow as set forth in claim 10 in which said limb adjustment means includes, a pivot plate positioned on said respective limb adjacent to said handle means, a pivot point on said handle means for pivotally receiving said pivot plate, threaded means for connecting said handle means to said pivot plate so that upon rotation of said threaded means said pivot plate pivots about said pivot point on said handle means, said handle means having a shoulder portion, said pivot plate having a shoulder portion, and said pivot plate shoulder portion arranged to engage said handle means shoulder portion to restrain further pivotal movement of said respective limb on said handle means after preselected rotation of said threaded means and thereby maintain said respective limb connected to said handle means.

12. A compound bow for propelling an arrow comprising, handle means for gripping the bow, said handle means having a cavity, said handle means having openings extending through opposite ends of said handle means and into said cavity, a pair of limb means extending outwardly from opposite ends of said handle means for storing energy to propel the arrow, continuous cable means for flexing said pair of limbs, eccentric wheel means attached to each of the free end portions of said limbs for movably supporting said cable means, said cable means having a first cable portion extending between each of said eccentric wheel means for receiving an arrow, said first cable portion having a pair of end portions, a second cable portion and a third cable portion, said second and third cable portions each having a first end, a second end, and an intermediate portion between said first and second ends, said first ends of said second end third cable portions being connected to said pair of end portions of said first cable portion, said second ends of said second and third cable portions being connected to said free end portions of said pair of limbs respectively, said intermediate portions of said second and third cable portions being arranged to pass through said openings and into and out of said cavity in said handle means, a pair of pulleys rotatably positioned in said cavity for supporting said cable intermediate portion, said pair of pulleys each including a large diameter portion having a peripheral groove and a small diameter portion having a peripheral groove, and said large and small diameter portions being coaxially mounted with one of said intermediate portions of said respective cable portions supported by both of said pulley small diameter portions and the other of said intermediate portions of said respective cable portions supported by both of said pulley large diameter portions so that said second and third cable portion cross in spaced overlying relation within said cavity.

13. A compound bow for propelling an arrow comprising, handle means for gripping the bow, a pair of limbs extending outwardly from opposite ends of said handle means for storing energy upon flexing, said pair of limbs having free end portions, continuous cable means for flexing said pair of limbs, eccentric wheel means attached to each said free end portions of said limbs for movably supporting said cable means, said cable means having a first cable portion extending between each of said eccentric wheel means for receiving an arrow, said first cable portion having a pair of end portions, a second cable portion and a third cable portion, said second and third cable portions each having a first end, a second end and an intermediate portion between said first and second ends, said first ends of said second and third cable portions each being connected to said pair of end portions of said first cable portion, said second ends of said second and third cable portions each being connected to said pair of limbs respectively, said cable intermediate portions arranged to extend around a portion of each of said free end portions of said limbs, and said eccentric wheel means each having an eccentric axis of rotation on each of said free end portions of said limbs, and eccentric adjustment means for adjusting the position of said eccentric axis of rotation of said eccentric wheel means relative to each of said free end portions of said limbs to adjust the draw weight and the draw length of the bow.

14. A compound bow as set forth in claim 13 in which, said eccentric wheel means includes an eccentrically positioned bore, said eccentric adjustment means including a cylindrical portion having a longitudinal axis, said cylindrical portion being positioned in said eccentrically positioned bore of said eccentric wheel means, a bore extending through said cylindrical portion, said bore being eccentrically positioned relative to said longitudinal axis to form an eccentric axis of rotation of said eccentric wheel means, means extending through said bore of said cylindrical portion for rotatably positioning said eccentric wheel means on each of said limbs respectively, and said cylindrical portion being rotatable within said bore of said eccentric wheel means to thereby change the position of said eccentric axis of rotation of said eccentric wheel means on each of said limbs respectively.

15. A bow for propelling an arrow comprising, handle means for gripping the bow, a pair of limbs extending outwardly from opposite ends of said handle means for storing energy upon flexing, said pair of limbs having free end portions, cable means extending between said free end portions for flexing said pair of limbs, limb adjustment means for pivotally connecting said limbs to said handle means for adjusting the flexure of said limbs to thereby permit adjustments in the draw weight of the bow, and said limb adjustment means including means for relaxing said pair of limbs on said handle means and preventing said pair of limbs from becoming disconnected from said handle means when said pair of limbs are in a relaxed position on said handle means, said pair of limbs each having a second end portion positioned oppositely of said respective free end portion, pivot means for supporting said second end portion of each limb on said handle means to permit pivotal movement of said limbs to a preselected pivotal position on said handle means, an abutment member supported by said handle means for movement about an eccentric axis of rotation to a preselected eccentric position on said handle means, said abutment member having a plurality of limb supporting surfaces being operable to support said respective limb second end portion in a preselected pivoted position on said handle means, said limb supporting surfaces each being selectively positioned in abutting relation with said respective limb second end portion corresponding to a preselected eccentric position of said abutment member to thereby rigidly support said respective limb second end portion in a corresponding pivoted position, and threaded means for maintaining said abutment member in a preselected eccentric position corresponding to a selected pivoted position of said respective limb.

16. A bow for propelling an arrow as set forth in claim 15 in which said means for relaxing said pair of limbs on said handle means includes, said handle means having a housing with an internal cavity therein and a shoulder portion on said housing within said cavity, a plate member secured to each limb adjacent to said handle means, said plate member having a portion projecting into said cavity, a shoulder extending from the end of said plate member portion, said plate member shoulder being spaced from said housing shoulder when said respective limb is pivoted to a preselected flexed position on said handle means, and said plate member shoulder being engageable with said housing shoulder to restrain pivotal movement of said respective limb on said handle means when said limb is moved to a relaxed position on said handle means so that said limb remains connected to said handle means.

* * * * *